US006148453A

United States Patent [19]

Sartor

[11] Patent Number: 6,148,453

[45] Date of Patent: Nov. 21, 2000

[54] SWINGING SHOWER APPARATUS

[76] Inventor: Giovanni Luigi Sartor, Avenue des Côteaux 168, B-4030 Liége, Belgium

[21] Appl. No.: 09/180,713

[22] PCT Filed: Oct. 14, 1996

[86] PCT No.: PCT/EP96/04512

§ 371 Date: Mar. 24, 1999

§ 102(e) Date: Mar. 24, 1999

[87] PCT Pub. No.: WO97/43047

PCT Pub. Date: Nov. 20, 1997

[51] Int. Cl.[7] ..... A47K 3/28

[52] U.S. Cl. ..... 4/615; 4/541.6

[58] Field of Search ..... 4/541.1, 541.3, 4/541.6, 615; 239/227, 263.1, 263.3, 264, 587.2, 587.3, 587.4

[56] References Cited

U.S. PATENT DOCUMENTS

| | | | |
|---|---|---|---|
| 3,874,595 | 4/1975 | Rindisbacher | 239/227 |
| 4,350,297 | 9/1982 | Martin | 239/587.4 X |
| 5,186,394 | 2/1993 | Tsuji | 239/587.4 |
| 5,321,860 | 6/1994 | Steinhardt et al. | 4/601 |
| 5,406,654 | 4/1995 | Antoine | 4/541.4 |

FOREIGN PATENT DOCUMENTS

| | | |
|---|---|---|
| 676 241 | 10/1995 | European Pat. Off. . |
| 2 681 244 | 3/1993 | France . |

*Primary Examiner*—Robert M. Fetsuga
*Attorney, Agent, or Firm*—Sughrue, Mion, Zinn, Macpeak & Seas, PLLC

[57] ABSTRACT

A shower device contains a body that is mounted in a support structure and that has a first pivoting element arranged so as to pivot about a first pivoting axis. A second pivoting element bearing a shower rose is mounted on the first pivoting element so as to be capable of pivoting about a second pivoting axis transverse to the first pivoting axis. A device is provided to impart to the body an oscillation movement about each of the first and second pivoting axes so as to cause regular spatial movement of a water jet according to a variety of programmable path cycles.

15 Claims, 15 Drawing Sheets

41
36
H
34
38
24
10
42
25
23
43
32
31
H
38
36

SWINGING SHOWER APPARATUS

FIELD OF THE INVENTION

The present invention falls within the field of installations intended to produce water jets, in particular shower devices.

STATE OF THE ART

Known shower devices comprise one or more shower roses which can in some cases be orientated manually and are arranged so as to form static jets. These known devices do not allow the whole body to take full advantage of the therapeutic effects of hydromassage because the water jets do not systematically and regularly reach the various parts of the body. Even a detachable shower rose cannot be hand-operated in a regular manner and produce a satisfactory effect.

Baths of the J-Sha type from Jacuzzi comprise a series of small jets arranged vertically along the back of the bath, which act directly on the cervical, dorsal and lumbar zones of the spinal column. In these baths, the jets are also static and do not allow the body to take full advantage of the beneficial effects of hydromassage either because the beneficial effect of the water jet comes above all from the movement of the water jet over the various parts of the body, in particular along the spinal column (stimulating or calming effect).

This sensation depends on the speed, the direction and the orientation of the movement of the water jet in relation to the body. It also depends on the receptiveness and the sensitivity of each individual, from which the importance of a shower space that is of sufficient size to allow freedom of movement of the body under the moving jet can be seen.

SUMMARY OF THE INVENTION

The object of the invention is to produce a dynamic shower device that allows the whole body of the user to take full advantage of the beneficial and therapeutic effects of hydromassage.

Another object of the invention is to produce a dynamic shower device arranged to generate a water jet having a continuous movement in space.

A further object of the invention is to produce a dynamic shower device arranged to generate a water jet, the movement of which in space can be adjusted by the user.

According to the invention, these objects are achieved by an oscillating device as defined in the claims. More specifically, the invention proposes a programmable device comprising a body bearing a shower rose for generating a water jet, in which the body is arranged so as to be capable of pivoting about at least one pivoting axis, and means for imparting to the body an oscillation movement about said pivoting axis.

In an advantageous embodiment, the pivoting body comprises a first element arranged so as to pivot about a first pivoting axis and a second element arranged so as to pivot about a second pivoting axis extending in a direction transverse to the first pivoting axis, said second element of the body bearing the shower rose. The pivoting body may be produced in various embodiments, three of which are described below by way of non-limiting examples.

Each oscillation movement can be controlled individually in terms of speed and extent, which makes it possible to vary continuously the direction of the water jet in space and thus to bring about unlimited variation of the trajectory of the water jet during the shower. This adjustment of the speed and of the extent of the oscillation movements as well as their sequencing in time are advantageously programmed by microprocessor.

By virtue of the invention, the shower rose is actuated with an oscillation movement in space, which varies according to the control program selected. The effect of this is to create a water jet which is variable in direction in space, which gives rise to a large range of trajectories of the water jet according to the program selected. This range of possibilities may comprise both programmed predefined trajectories and sequences of trajectories that the user can define personally. The effects of hydromassage are thus reinforced, in this way favouring the beneficial therapeutic effect of the shower.

The invention is explained in greater detail in the following description of three exemplary embodiments illustrated in the appended drawings.

BRIEF DESCRIPTION OF THE DRAWINGS

In the drawings, the same reference numbers designate identical, similar or equivalent elements.

DESCRIPTION OF EMBODIMENTS OF THE INVENTION

Figure 1:
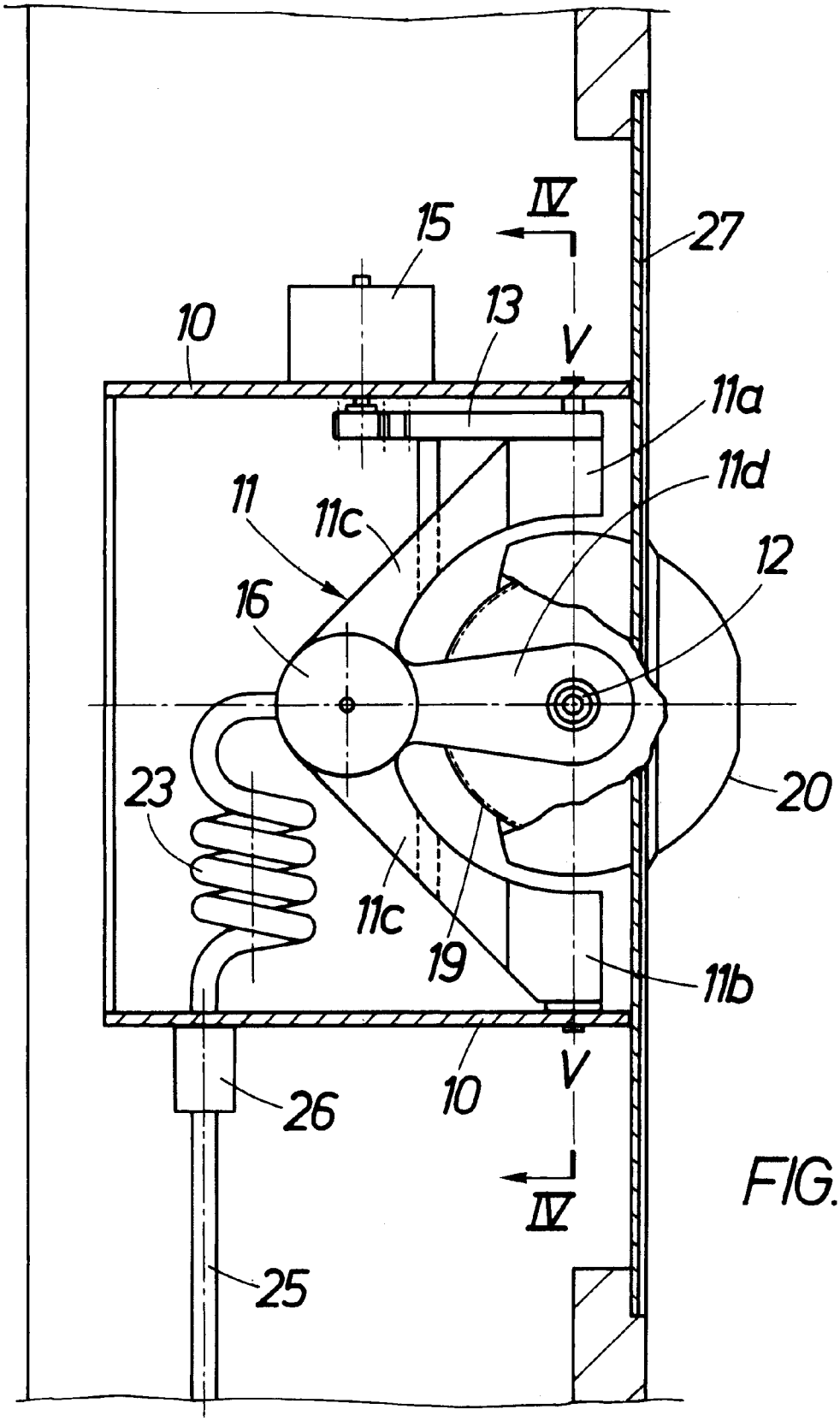
FIG. 1 is an elevation with a cut-away of a first exemplary embodiment of the invention.
Figure 2:
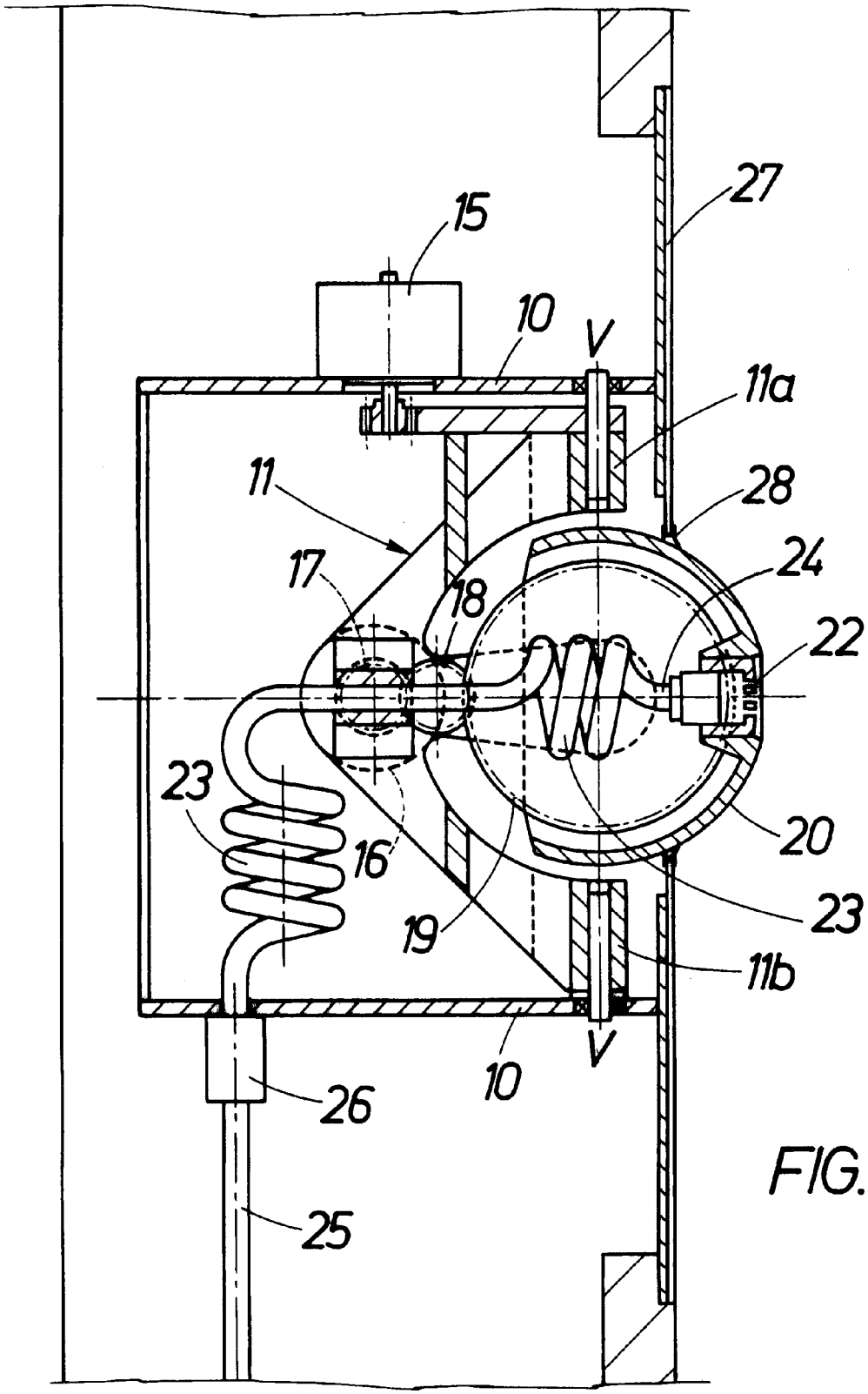
FIG. 2 shows a section along the line II—II in FIG. 4.
Figure 3:
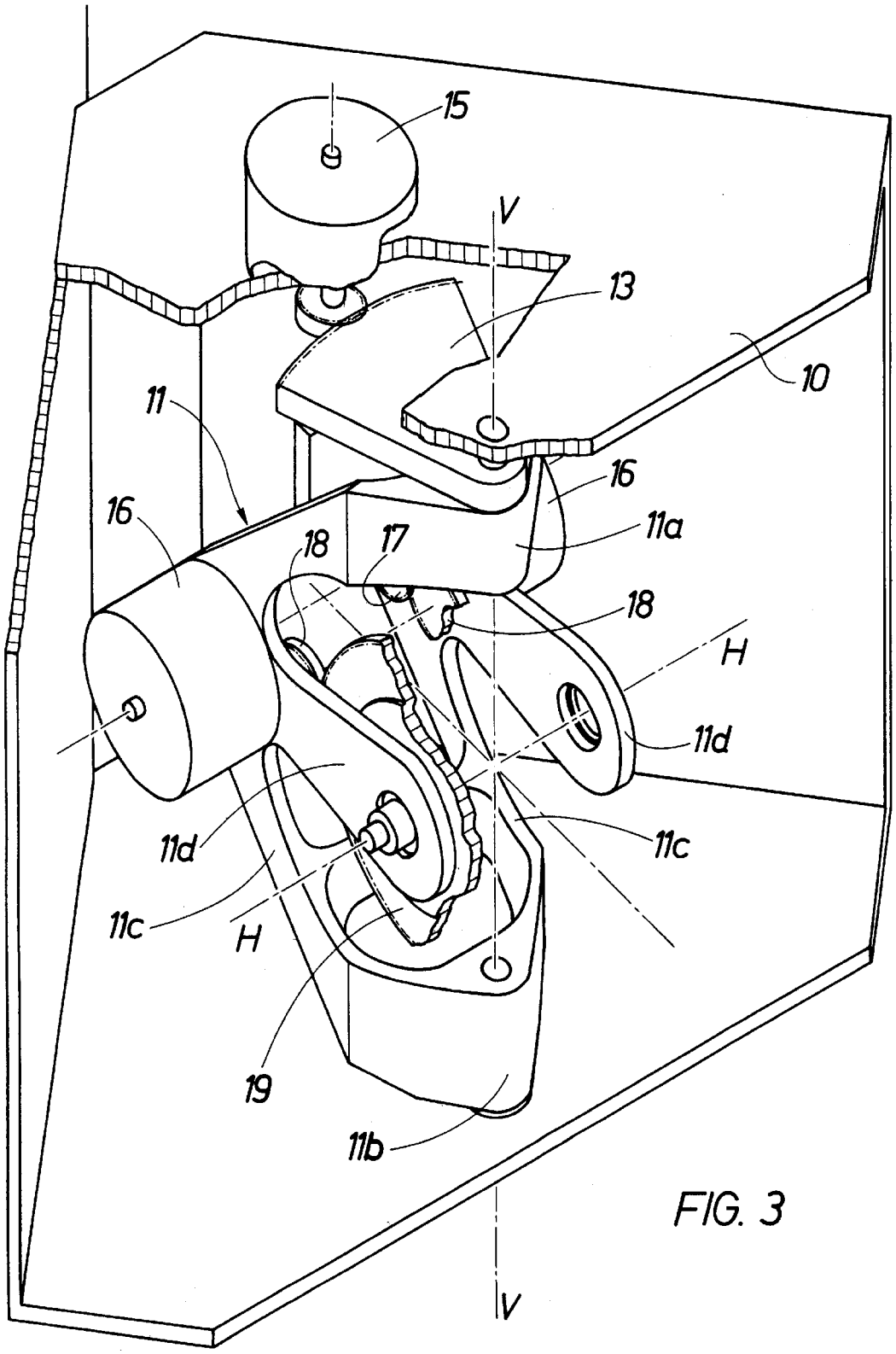
FIG. 3 is a partial perspective view, with a cut-away, showing the pivoting frame of the device in FIG. 1, without water inlet pipe.
Figure 4:
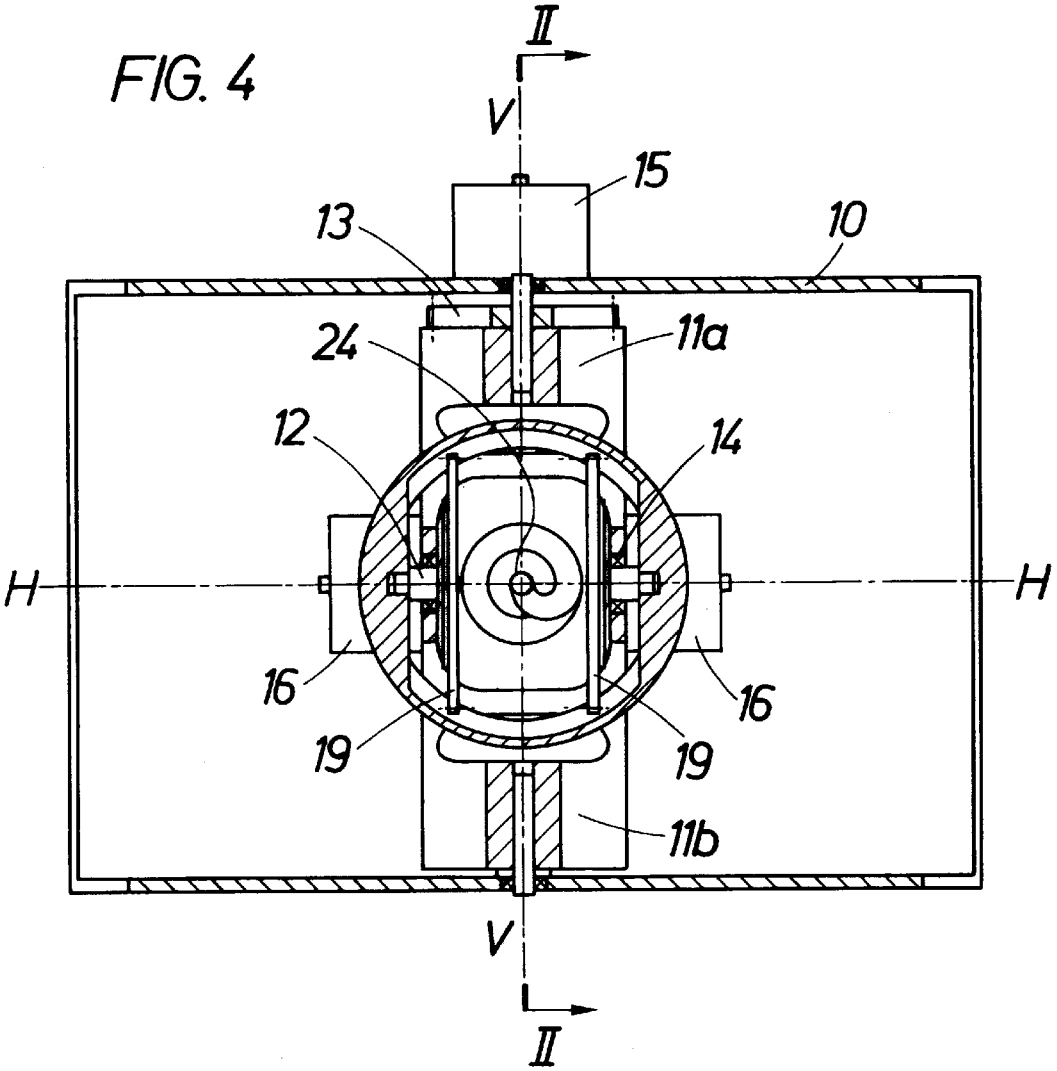
FIG. 4 shows a section along the line IV—IV in FIG. 1.

A first embodiment is illustrated in FIGS. 1 to 5. The device is mounted in a support structure 10 and comprises a pivoting frame 11 mounted so as to be capable of pivoting about a vertical pivoting axis V—V. In the embodiment illustrated, the pivoting frame comprises two branches 11*c* which extend in an arch-shape between two common heads 11*a* and 11*b*. The general shape of the frame 11 is clearly visible in FIG. 3. These heads of the frame 11 are arranged so as to be capable of pivoting about a vertical pivoting axis V—V. Each branch of the pivoting frame has a projecting arm 11*d* which serves as a support for a spindle 12 defining a second pivoting axis H—H transverse to the first pivoting axis V—V. The spindle 12 is attached to each of the arms by a plain bearing or a ball bearing 14. Attached to the spindle 12 is a shower rose 20 which, in the embodiment illustrated by way of example, consists of a hemispherical shell, on the surface of which at 22 a water inlet pipe 24 (visible in FIG. 2) opens, which pipe is connected to a water supply circuit 25, in which an electrovalve 26 is included.

The pivoting movements of the frame 11 are controlled by electric motors, for example stepping motors or DC motors. For controlling the pivoting about the axis V—V, the frame 11 bears a sector 13 which is coupled to an electric motor 15. The rotation of the spindle 12 about the pivoting axis H—H is controlled by two electric motors 16 by means of toothed wheels 17–19.

When the motors are started, the pivoting frame 11 oscillates horizontally, for example within an angle having an aperture of around 45°, while the spindle 12 bearing the hemispherical shell 20 oscillates vertically, for example within an angle having an aperture of around 80°. The hemispherical shell thus oscillates in space, directing the water jet successively in different directions in space. At a distance of 60 cm from the shower rose, the water jet can thus cover an action zone extending from the neck to the knees of a user and, moreover, across the entire width of the trunk of the user. This allows the body of the user to take full advantage of the beneficial and/or therapeutic effects of the shower.

The speed and the extent of each oscillation movement and their sequencing in time can be adjusted individually. This makes it possible to bring about unlimited variation of the trajectory of the water jet in space during the shower. Adjustment of the parameters of the oscillation movements is advantageously programmed by a microprocessor.

So as to allow the end of the water pipe 24 to follow the oscillation movements of the shower rose, the water pipe comprises or is connected to at least one part 23 which is flexible or shaped so as to have sufficient flexibility.

Reference number 27 in the drawings designates a fixed front panel and reference number 28 designates a seal.

Figure 5:
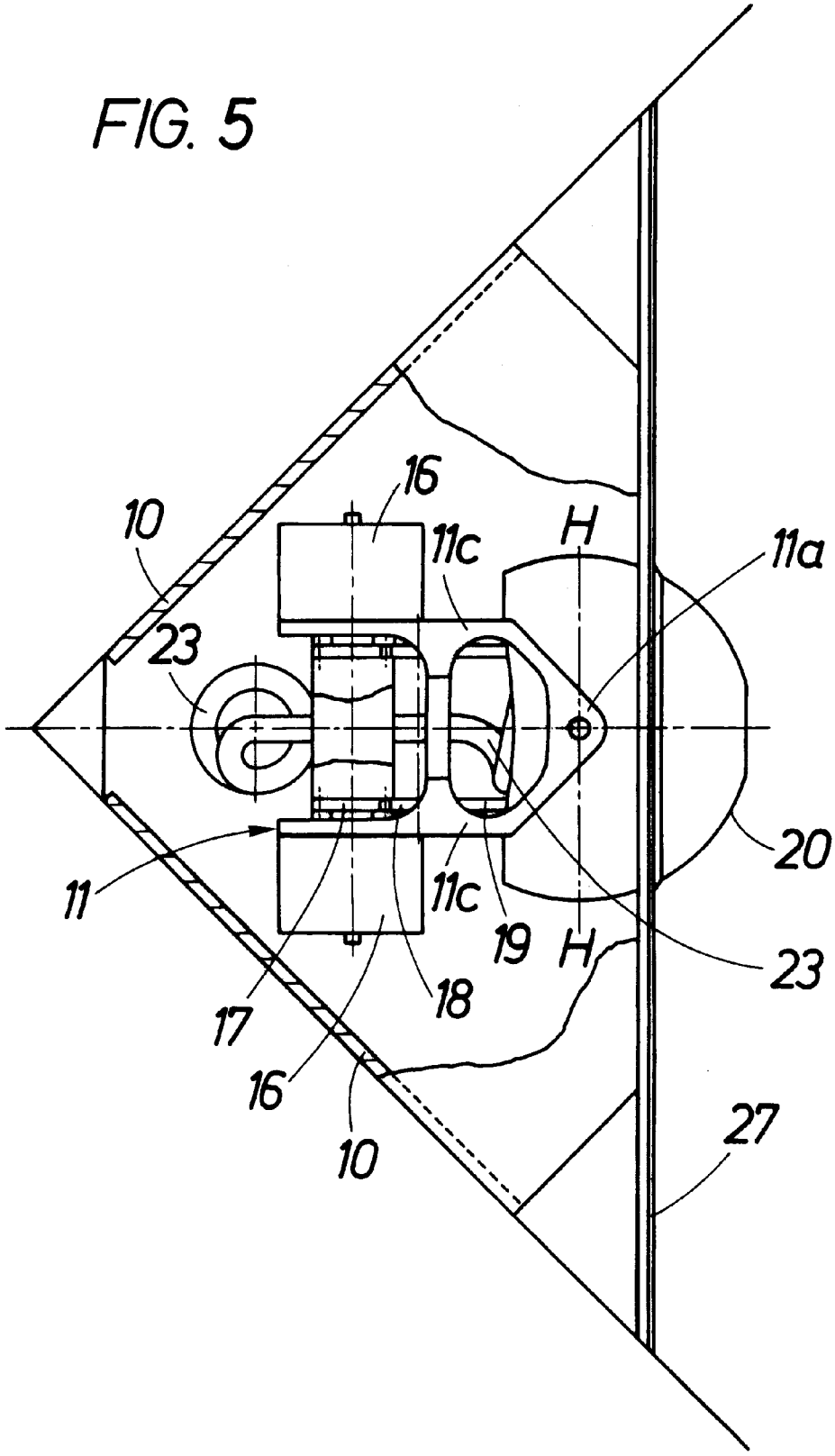
FIG. 5 is a view, with a cut-away, of the device in FIG. 1 mounted in a corner, showing the pivoting frame viewed from above.
Figure 6:
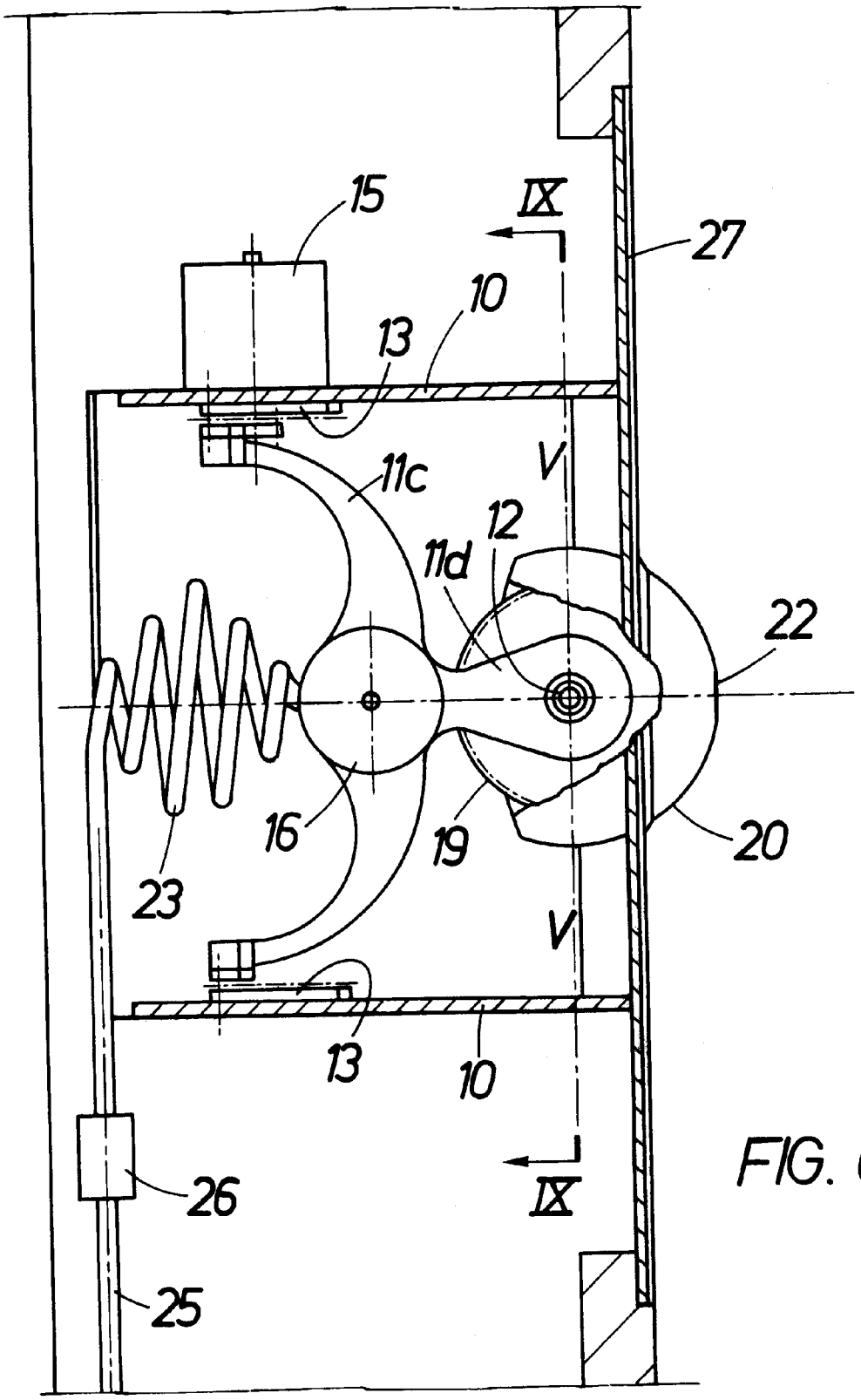
FIG. 6 is an elevation, with a cut-away, of a second exemplary embodiment of the invention.
Figure 7:
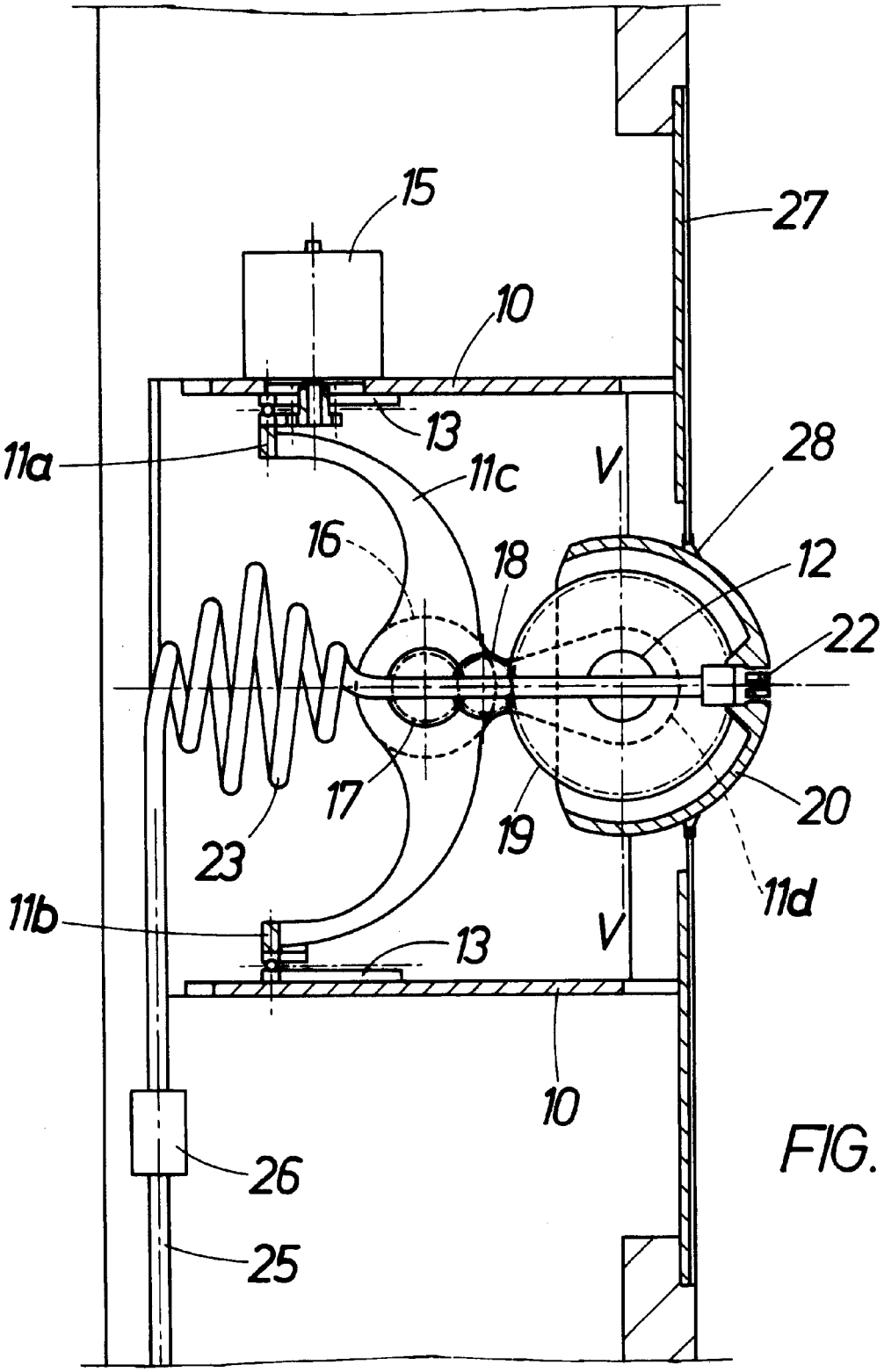
FIG. 7 shows a section along the line VII—VII in FIG. 9.

Although the device is shown mounted in a corner in FIG. 5, it is clear that it may be mounted on a flat wall. Furthermore, it is clear that the device may be mounted not only in a fixed manner but also so as to be capable of sliding along a rigid structure.

It is clear that the pivoting frame 11 may be realized in an embodiment different to that illustrated by way of example in FIGS. 1 to 5. Similarly, it goes without saying that the transverse pivoting axes arranged on the pivoting frame may be reversed in relation to those defined by the arrangements illustrated in FIGS. 1 to 5.

Figure 8:
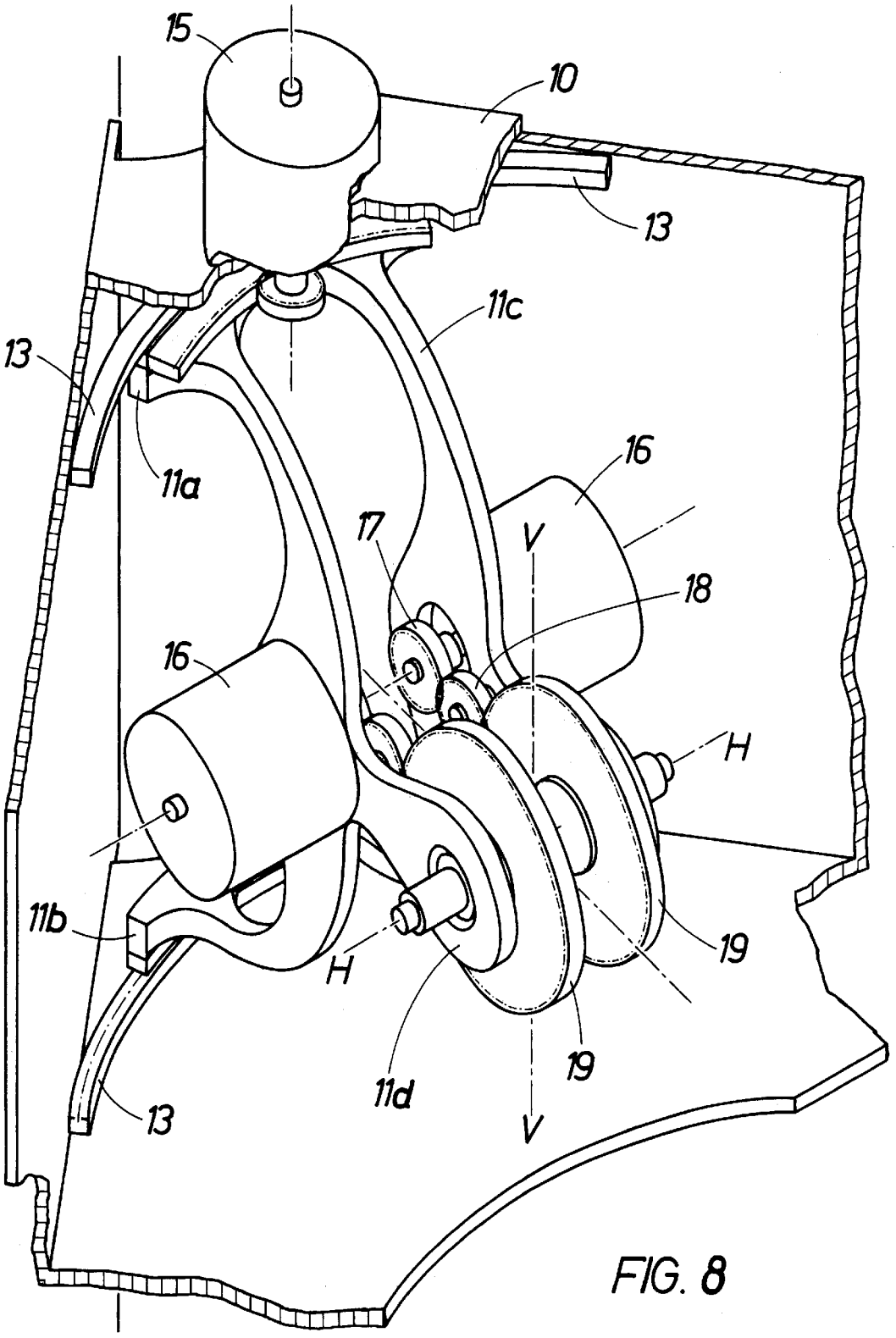
FIG. 8 is a partial perspective view, with a cut-away, showing the pivoting frame of the device in FIG. 6, without water inlet pipe.
Figure 9:
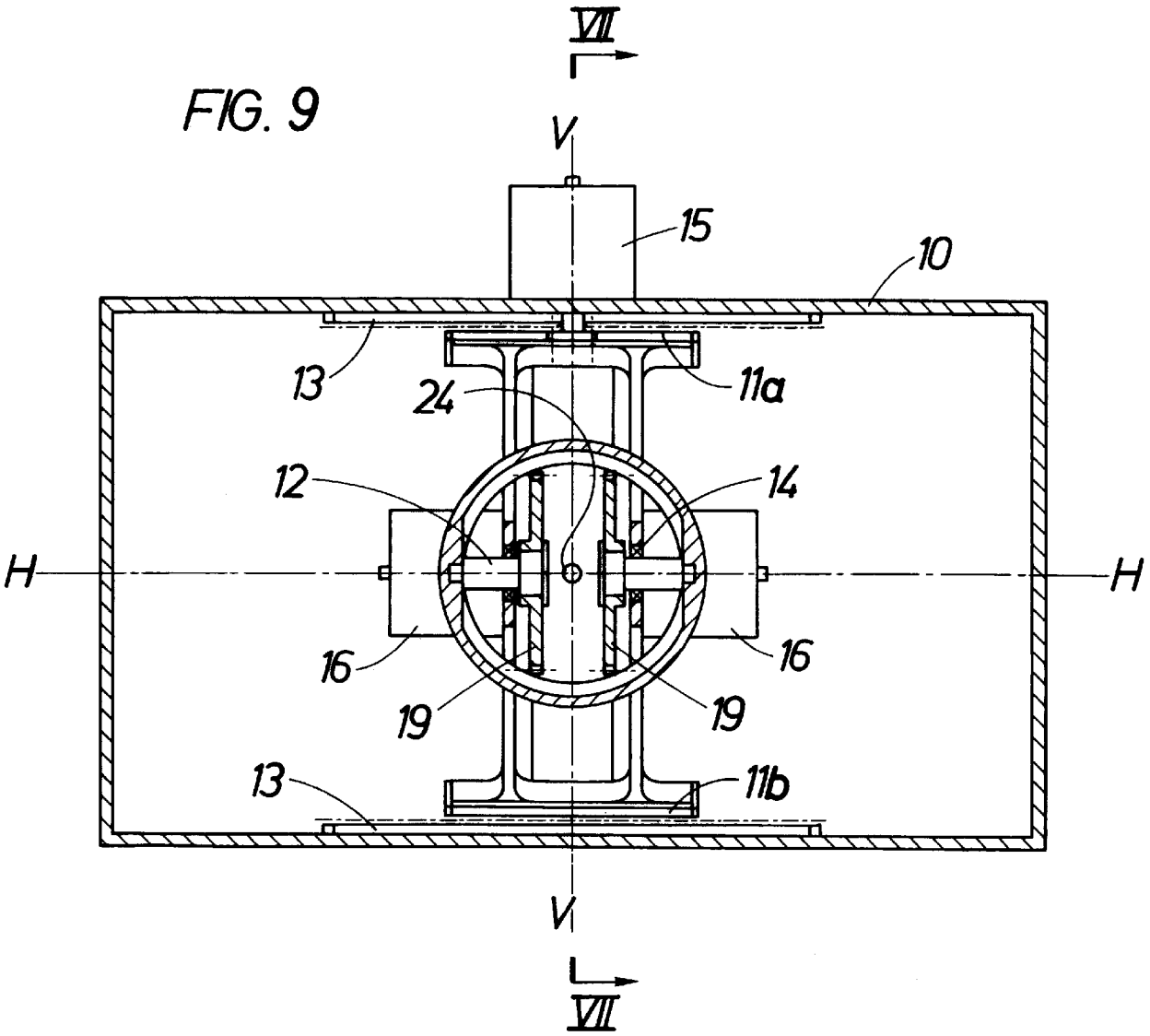
FIG. 9 shows a section along the line IX—IX in FIG. 6.
Figure 10:
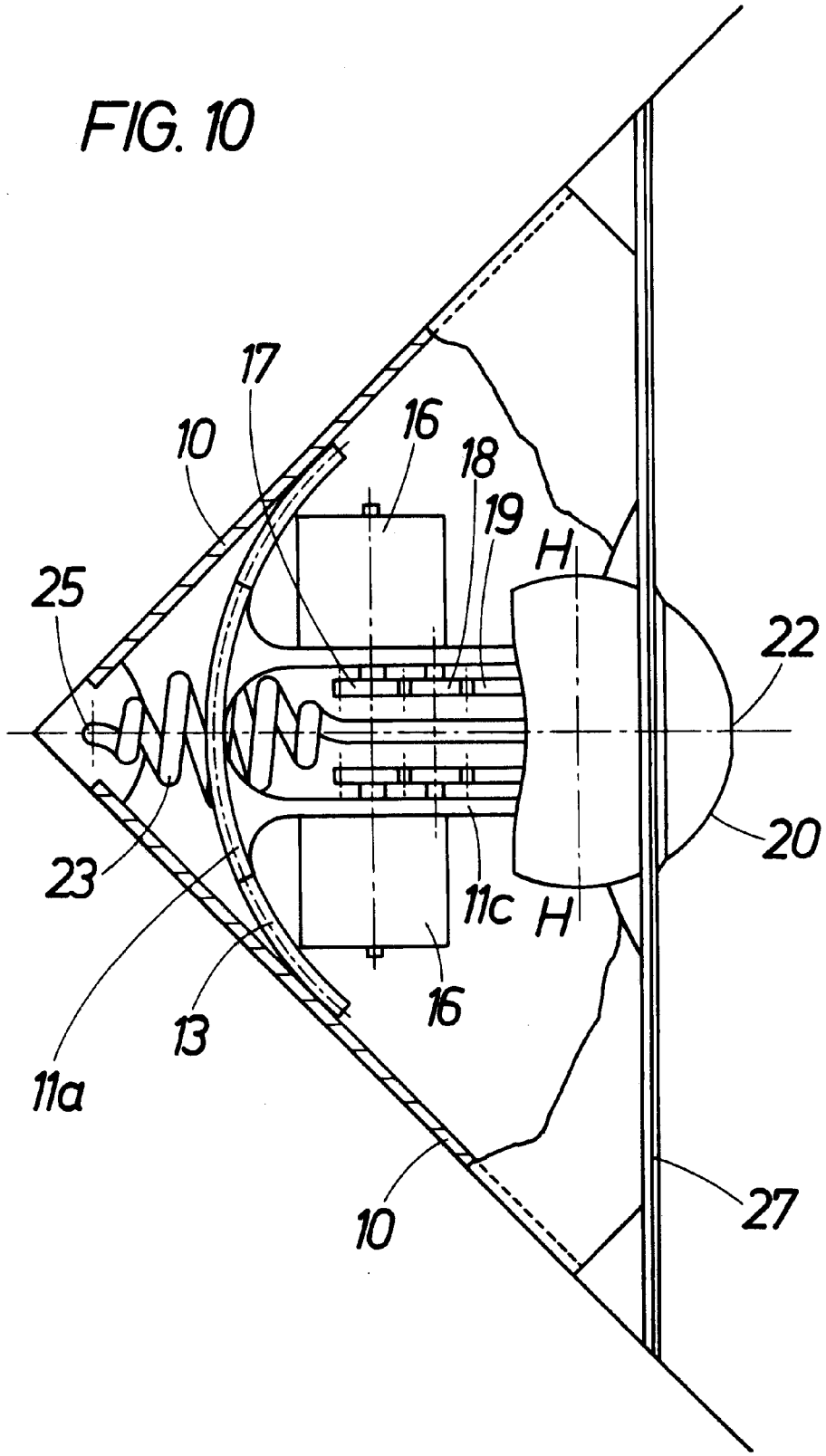
FIG. 10 is a view, with a cut-away, of the device in FIG. 6 mounted in a corner, showing the pivoting frame viewed from above.

FIGS. 6 to 10 illustrate a second exemplary embodiment of the invention. This embodiment is similar to that described above but employs a pivoting frame 11 in a variant embodiment. In this embodiment, the heads 11*a* and 11*b* of the frame 11, clearly visible in FIG. 8, are curved and are mounted so as to slide along two guide rails 13 having the shape of an arc of a circle, the curvature of which is defined in such a manner that their centres of curvature are located on one and the same vertical axis which defines the pivoting axis V—V.

The pivoting axis H—H is formed, as in the example described previously, by a horizontal spindle 12 which is supported by the two arms 11*d* projecting on the arch-shaped branches 11*c*. The pivoting axis H—H intersects the pivoting axis V—V so as to fix a central pivoting point which is fixed in space and about which the shower rose shell 20 oscillates.

Figure 11:
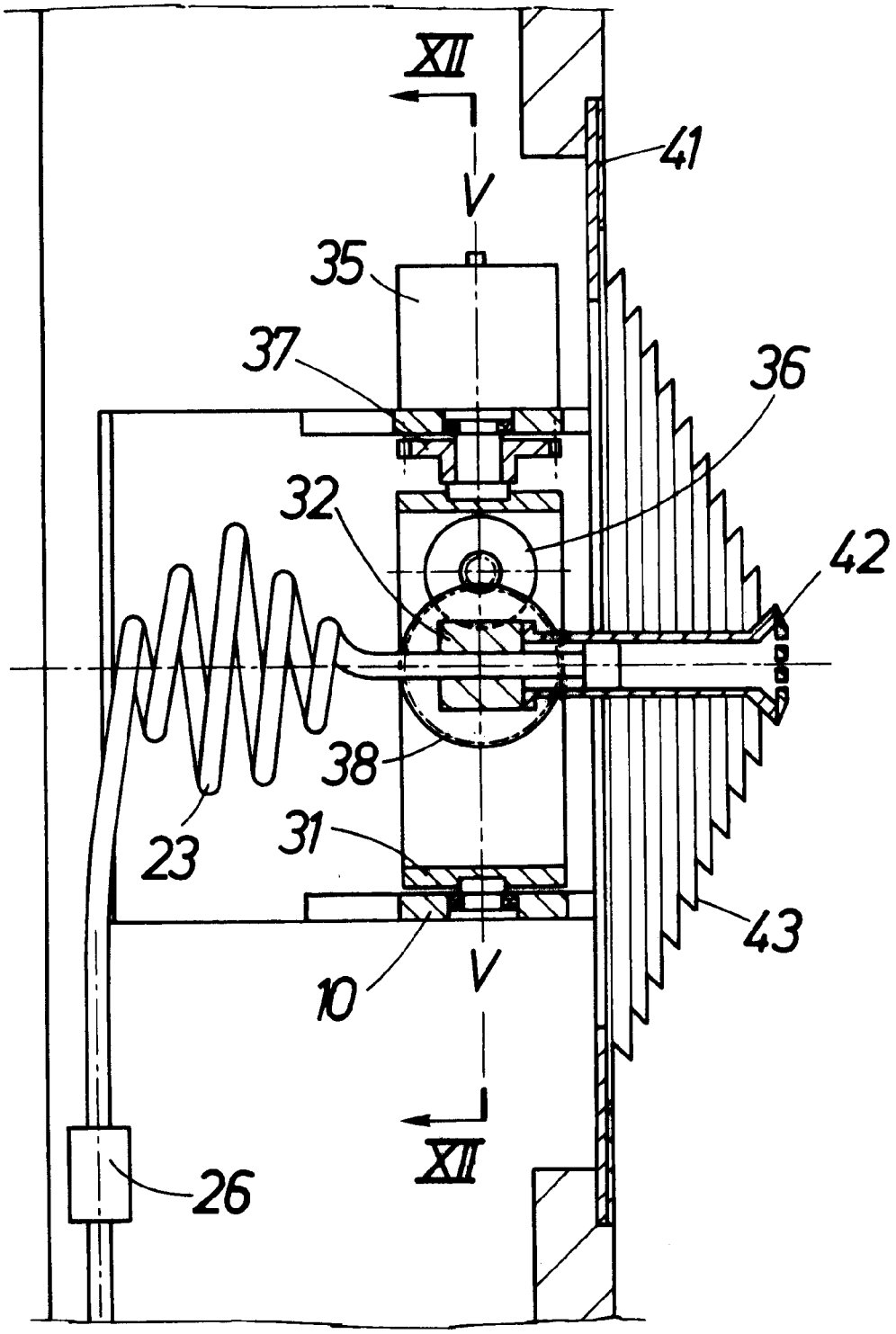
FIG. 11 is a view in section along the line XI—XI in FIG. 12 showing a third exemplary embodiment of the invention.
Figure 12:
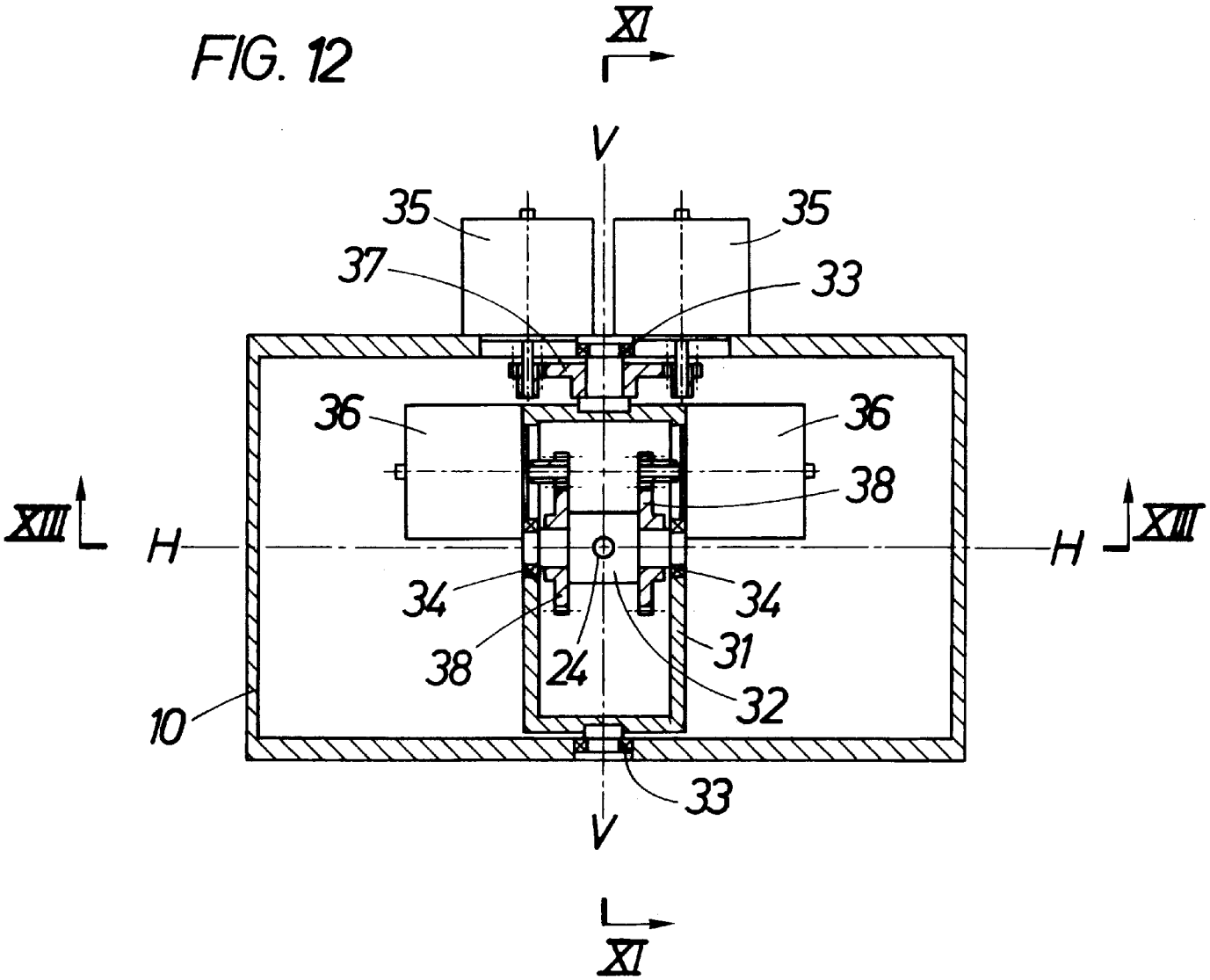
FIG. 12 shows a section along the line XII—XII in FIG. 11.
Figure 13:
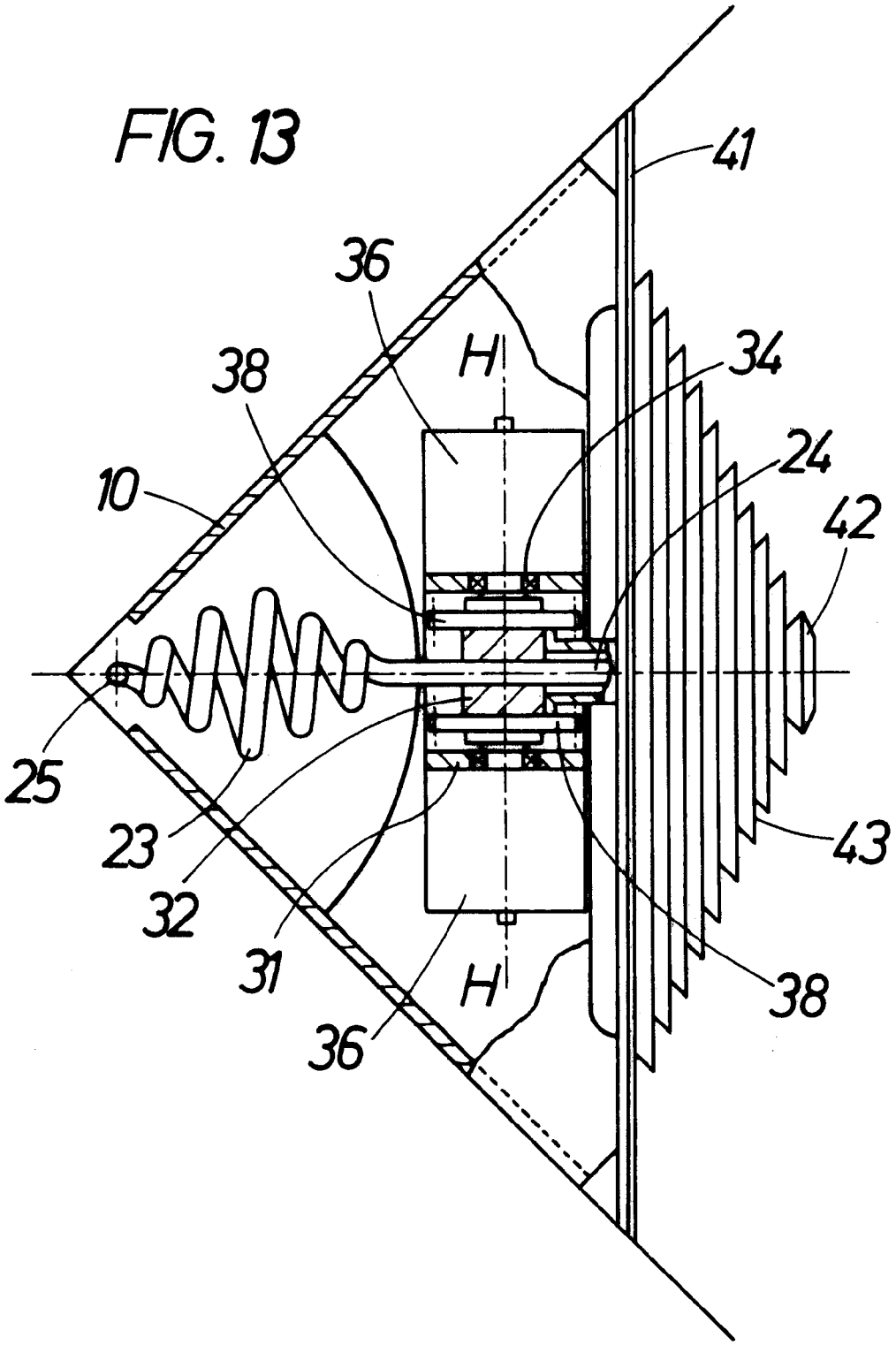
FIG. 13 shows a section along the line XIII—XIII in FIG. 12.

FIGS. 11 to 13 illustrate a third exemplary embodiment of the invention. In this example, the device comprises two pivoting frames. A first frame 31 is mounted so as to be capable of pivoting about a first pivoting axis V—V defined by the plain bearings or the ball bearings 33 attached to a support structure 10. A second frame 32 is mounted so as to be capable of pivoting about a second pivoting axis H—H transverse to the first pivoting axis and defined by the plain bearings or the ball bearings 34 attached to the frame 31. Each of the frames 31 and 32 is coupled to motors 35, and 36 by means of toothed wheels 37 and 38.

The shower rose 42 is attached to the frame 32 and is connected to the water inlet pipe 24. The shower rose 42 is connected to a cover plate 41 via a bellows seal 43.

When the motors are started, the pivoting frame 31 oscillates horizontally about the pivoting axis V—V, for example within an angle having an aperture of around 45°, and the pivoting frame 32 bearing the shower rose 42 oscillates vertically about the pivoting axis H—H, for example within an angle having an aperture of around 80°. The shower rose is thus orientated in a variable manner in space, directing the water jet successively in different directions in space. As indicated above with regard to the first exemplary embodiment described, at a distance of 60 cm from the shower rose, the water jet can thus cover an action zone extending from the neck to the knees of the user and, moreover, across the entire width of the trunk of the user, in this way providing for the user all the beneficial and/or therapeutic effects of the shower.

In the same way as in the previous embodiment, the transverse pivoting axes arranged on the elements constituting the pivoting frame may be reversed in relation to those provided in the arrangement illustrated in FIGS. 11 to 13.

By virtue of adjustable programming of the parameters (speed and extent) of the oscillation movements and their sequencing in time, the invention makes it possible to bring about unlimited variation of trajectories of the water jet in space during the shower and, what is more, as the user pleases so that full advantage may be taken, at the convenience of the user, of the effects of the shower on the body.

Figure 14:
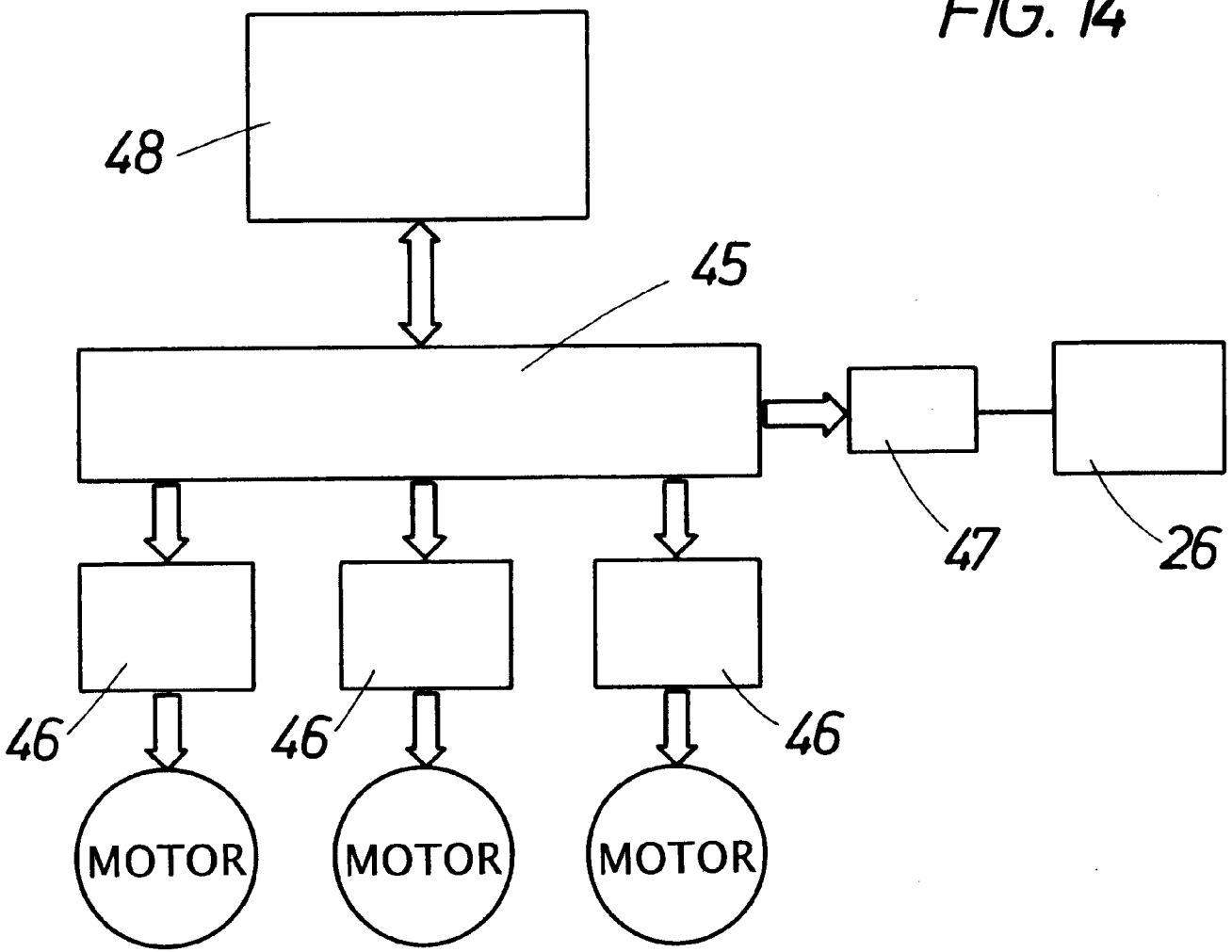
FIG. 14 is a basic diagram of a shower control device according to the invention.

Advantageously, the programming of the parameters of the oscillation movements in space is carried out by a microprocessor. FIG. 14 is a basic diagram of the programmed control of the shower device according to the invention. The microprocessor 45 communicates with control devices 46 which actuate the stepping motors controlling the horizontal pivoting movement of the pivoting frame and the vertical pivoting movement of the shower rose. The microprocessor also controls a relay 47 controlling an electrovalve 26 included in the water supply circuit 25. The microprocessor 45 receives the instructions for adjustment of the parameters of the oscillation movements of the water jet from a control panel 48, on which the values for adjustment of the oscillations as well as the types of water jet trajectory that have been defined or are to be defined are indicated.

To use the shower device according to the invention, the user personally selects on the control panel 48 the desired mode of action from among the available options and the parameters of the oscillation movements of the water jet in space.

Figure 15:
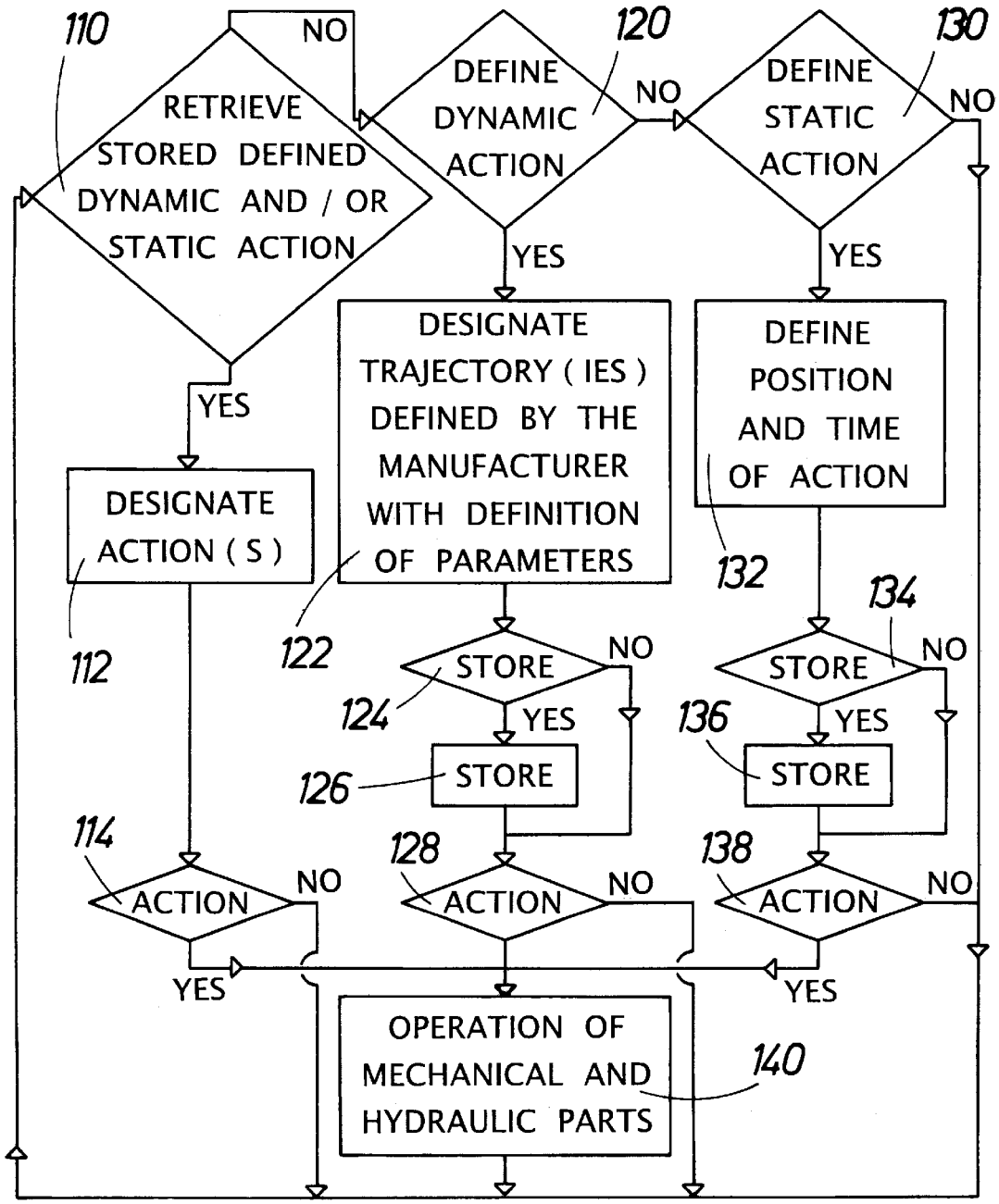
FIG. 15 is a flow diagram illustrating the modes of action, available to the user, of a shower device according to the invention.

The flow diagram in FIG. 15 illustrates by way of example an embodiment for the control of a shower device according to the invention when the power supply to the device is switched on.

In this example, after the centring of the water jet, the device is organized so as to make it possible to designate three modes of action. The control stages are described below.

Stage 110: Selection of a stored mode of action In this mode of action, the trajectories of the water jet are effected according to parameters stored beforehand by the user.

Stage 112: Designation of dynamic and/or static actions defined and stored by the user.

Stage 114: Designated action.

Stage 120: Selection of a dynamic mode of action In this mode of action, the water jet follows trajectories defined by the manufacturer on the basis of parameters that the user adjusts.

Stage 122: Designation of trajectories defined by the manufacturer with definition of parameters for dynamic action. These parameters relate to, for example, the following data:

NC Number of cycles for the action to be defined—counting—after the definition of the parameters of each cycle.

CN Cycle number

OA Origin of action—Position in relation to the centred position of the moving part of the device.

TR Trajectory of the water jet.

SA Orientation of the action, from the top towards the bottom or vice versa.

RA Return action, with or without water jet.

VA Speed of action.

VR Speed of return.

AS Upper vertical extent.

AI Lower vertical extent.

AH Horizontal extent.

TC Time calculated for a cycle.

NP Number of passes with the same trajectory.

TP Partial time for the trajectory.

TT Total time of the dynamic action.

Stage 124: Selection of whether or not to store designated trajectories and parameters defined in stage 122.

Stage 126: Storage.

Stage 128: Designated action.

Stage 130: Selection of a static mode of action In this mode of action, the water jet is fixed in space with an orientation and a given duration of time selected by the user.

Stage 132: Definition of the position of the water jet in the vertical plane and in the horizontal plane, and definition of the action time.

Stage 134: Selection of whether or not to store the position of the water jet and the action time defined in stage 132.

Stage 136: Storage.

Stage 138: Designated action.

Stage 140: Operation of the mechanical and hydraulic parts for the designated action.

Once the adjustments have been made by the user, the selected action cycle takes place under the programmed control of the microprocessor.

The action control example described above shows the large range of movements of the water jet in space that the invention makes it possible to perform according to the preference of the user. This range of possibilities may also comprise both programmed predefined trajectories (for example random trajectories with a uniform or variable sawtooth shape, in successive loops with or without interruption, in spirals etc.) and sequences of trajectories that the user defines personally. The effect of the hydromassage can thus, by virtue of the invention, be optimized to the liking of each user.

The programmed control of the trajectory of the water jet according to the invention may advantageously be complemented by adjustment of the water flow rate depending on the direction of the jet and/or adjustment of the temperature of the water of the jet.

It is of course understood that the embodiments described above and illustrated in the appended drawings are simply examples given in order to illustrate the principles of the invention and that the latter is in no way limited to these examples. All variants or modified embodiments are to be considered as falling within the scope of the invention defined in the claims.

What is claimed is:

1. A shower device comprising:

a body, said body being mounted in a support structure and comprising a first pivoting element arranged so as to pivot about a first pivoting axis, means arranged on said pivoting element for defining a second pivoting axis transverse to said first pivoting axis, and a second pivoting element attached to said means defining said second pivoting axis so as to be capable of pivoting about said second pivoting axis, a shower rose having a shape of a substantially hemispherical shell which is provided with a water inlet and with at least one water outlet so as to produce at least one water jet and which is fixedly mounted on said second pivoting element, first means for imparting to said first pivoting element an oscillation movement about said first pivoting axis; and second means for imparting to said second pivoting element an oscillation movement about said second pivoting axis, independently of said first means for imparting an oscillation movement.

2. Device according to claim 1, characterized in that the first pivoting element comprises a frame (11) comprising two heads (11*a,* 11*b*) mounted so as to pivot about a first pivoting axis (for example V—V) and an arm (11*d*) serving as a support for the second pivoting element (12) bearing the shower rose.

3. Device according to claim 2, characterized in that the heads (11*a,* 11*b*) of the pivoting frame (11) are fixed to a pivoting means (13) controlled by an actuating means (15) so as to impart to the frame (11) a pivoting movement about said first pivoting axis.

4. A shower device comprising:

a body, said body being mounted in a support structure and comprising a first pivoting element arranged so as to pivot about a first pivoting axis;

means arranged on said pivoting element for defining a second pivoting axis transverse to said first pivoting axis, and a second pivoting element attached to said means defining said second pivoting axis so as to be capable of pivoting about said second pivoting axis, said second pivoting element bearing a shower rose arranged so as to produce at least one water jet; and means for imparting to said body an oscillation movement about each of said first and second pivoting axes;

wherein the first pivoting element comprises a frame (11) comprising two heads (11*a,* 11*b*), mounted so as to pivot about a first pivoting axis, and an arm (11*d*) serving as a support for the second pivoting element (12) bearing the shower rose; and wherein the heads (11*a,* 11*b*) of the pivoting frame (11) are arranged so as to slide along guides (13) fixed to support means (10), the guides having a curvature.

5. A shower device comprising:

a body, said body being mounted in a support structure and comprising a first pivoting element arranged so as to pivot about a first pivoting axis;

means arranged on said pivoting element for defining a second pivoting axis transverse to said first pivoting axis, and a second pivoting element attached to said means defining said second pivoting axis so as to be capable of pivoting about said second pivoting axis said second pivoting element bearing a shower rose arranged so as to produce at least one water jet; and means for imparting to said body an oscillation movement about each of said first and second pivoting axes;

wherein the shower rose (20) consists of a shell, on the surface of which a water inlet pipe opens, and wherein said shell (20) has a virtually hemispherical shape.

6. Device according to claim 1, characterized in that the first pivoting element comprises a first frame (31) arranged so as to pivot about a first axis of rotation (for example V—V), means (34) arranged on the first pivoting frame so as to define a second axis of rotation (for example H—H) transverse to said first axis, and in that the second pivoting element comprises a second frame attached so as to be capable of oscillating about the second axis of rotation (H—H), said second frame bearing the shower rose (42).

7. Device according to claim 1, characterized in that the shower rose (42) is connected to a fixed element of the device by means of a deformable element (43).

8. A shower device comprising:

a body, said body being mounted in a support structure and comprising a first pivoting element arranged so as to pivot about a first pivoting axis;

means arranged on said pivoting element for defining a second pivoting axis transverse to said first pivoting axis, and a second pivoting element attached to said means defining said second pivoting axis so as to be capable of pivoting about said second pivoting axis said second pivoting element bearing a shower rose arranged so as to produce at least one water jet; and means for imparting to said body an oscillation movement about each of said first and second pivoting axes;

wherein the means for imparting the oscillation movements to the pivoting frame consists of stepping motors or DC motors.

9. Shower device according to claim 1, characterized in that the means for imparting the oscillation movements to the pivoting elements are controlled by a microprocessor.

10. Shower device according to claim 9, characterized in that the microprocessor is run by a program for adjusting the speed, the extent and other parameters of the oscillation movements of the pivoting elements of the body of the device.

11. A shower device comprising:

a body, said body being mounted in a support structure and comprising a first pivoting element arranged so as to pivot about a first pivoting axis;

means arranged on said pivoting element for defining a second pivoting axis transverse to said first pivoting axis, and a second pivoting element attached to said means defining said second pivoting axis so as to be capable of pivoting about said second pivoting axis said second pivoting element bearing a shower rose arranged so as to produce at least one water jet: and means for imparting to said body an oscillation movement about each of said first and second pivoting axes;

wherein the means for imparting the oscillation movement to the pivoting elements is controlled by a microprocessor, and wherein the microprocessor controls an electrovalve included in a water supply circuit.

12. Shower device according to claim 10, characterized in that it comprises a control panel for modifying the adjustment program and controlling the parameters of the oscillation movements and/or the types of trajectory of the water jet in space.

13. A water jet device comprising:

a body arranged so as to emit at least one water jet in space, said body being mounted in a support structure and comprising a first pivoting element arranged so as to pivot about a first pivoting axis, means arranged on said pivoting element for defining a second pivoting axis transverse to said first pivoting axis, and a second pivoting element attached to said means defining said second pivoting axis so as to be capable of pivoting about said second pivoting axis said second pivoting element bearing a shower rose arranged so as to produce at least one water jet; and means for imparting to said body an oscillation movement about each of said first and second pivoting axes.

14. A shower device comprising:

a body, said body being mounted in a support structure and comprising a first pivoting element arranged so as to pivot about a first pivoting axis;

means arranged on said pivoting element for defining a second pivoting axis transverse to said first pivoting axis, and a second pivoting element attached to said means defining said second pivoting axis so as to be capable of pivoting about said second pivoting axis, said second pivoting element bearing a shower rose arranged so as to produce at least one water jet; and means for imparting to said body an oscillation movement about each of said first and second pivoting axes;

wherein the means for imparting the oscillation movement to the pivoting elements is controlled by a microprocessor, wherein the microprocessor is run by a program for adjusting the speed, the extent and other parameters of the oscillation movement of the pivoting elements of the body of the device, and wherein the microprocessor controls an electrovalve included in a water supply circuit.

15. The shower device according to claim 1, wherein said second pivoting element, said means arranged for defining said second pivoting axis and said second means for imparting an oscillation movement are at least partially located within the substantially hemispherical shell of the shower rose.

* * * * *